US006971339B2

(12) United States Patent
Janssen

(10) Patent No.: US 6,971,339 B2
(45) Date of Patent: Dec. 6, 2005

(54) ELECTROMAGNETIC SERVO VALVE STRATEGY FOR CONTROLLING A FREE PISTON ENGINE

(75) Inventor: Hendrikus Janssen, Maastricht (NL)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/840,456

(22) Filed: May 6, 2004

(65) Prior Publication Data

US 2005/0247271 A1 Nov. 10, 2005

(51) Int. Cl.[7] ..... F02B 71/00
(52) U.S. Cl. ..... 123/46 R
(58) Field of Search ..... 123/46 R, 46 SC, 123/46 E, 46 A, 46 B; 417/364

(56) References Cited

U.S. PATENT DOCUMENTS 5,213,067 A 5/1993 Kramer
5,829,393 A 11/1998 Achten et al.
5,983,638 A * 11/1999 Achten et al. ..... 60/595
6,105,541 A 8/2000 Berlinger
6,158,401 A 12/2000 Bailey
6,170,443 B1 1/2001 Hofbauer
6,206,656 B1 3/2001 Bailey et al.
6,279,517 B1 8/2001 Achten
6,293,231 B1 * 9/2001 Valentin ..... 123/46 R
6,823,671 B2 * 11/2004 Achten ..... 60/413

OTHER PUBLICATIONS

Goertz et al., SAE Technical Paper Series 2000-01-0996, Free Piston Engine Its Application and Optimization, Mar. 6-9, 2000, pp. 1-10.

* cited by examiner

*Primary Examiner*—Henry C. Yuen
*Assistant Examiner*—Hyder Ali
(74) *Attorney, Agent, or Firm*—David B. Kelley; MacMillan, Sobanski & Todd

(57) ABSTRACT

A method for controlling a servo for an actuator that applies a force to a piston that reciprocates in a cylinder of a free piston engine having axially-aligned cylinders and a pair of mutually connected pistons that reciprocate in the cylinders. The servo has a first state at which an energy source is connected to the actuator for developing the actuating force. The length of a response period for the actuator force to reach a desired magnitude after applying a control signal to the servo is determined. The length of a period for the piston to reach a desired position where the actuator force will reach the desired magnitude is determined. The servo is switched to the first state when the length of time for the piston to move from its current position to the desired position reaches the length of the response period.

14 Claims, 7 Drawing Sheets

ELECTROMAGNETIC SERVO VALVE STRATEGY FOR CONTROLLING A FREE PISTON ENGINE

BACKGROUND OF THE INVENTION

The invention relates to internal combustion engines. In particular, the invention pertains to controlling the application and magnitude of a periodic force applied by an actuator that reciprocates a piston while starting a free piston engine.

A free piston internal combustion engine includes one or more reciprocating pistons located in a combustion cylinder. But there is no crankshaft mutually connecting the pistons and causing them to reciprocate when actuated by a starter-alternator, as in a conventional internal combustion engine. In a free piston engine running under normal operation, each piston moves during an expansion stroke in its cylinder in response to forces produced by combustion of an air-fuel mixture in the cylinder. Pressure produced by combustion in one cylinder is used to compress an air-fuel charge in another cylinder. Before combustion occurs while starting the engine, an actuating system is be used to compress the air-fuel charge following the expansion stroke. Motion of the pistons is controlled by a system, which synchronizes piston reciprocation, compression of the air-fuel mixture, and its combustion. Piston displacement and velocity, cylinder pressure, and the compression ratio are monitored and controlled by the system, which periodically corrects deviations from desired, synchronized reciprocation of the pistons.

While starting a free piston engine, the pistons are displaced by a starter-actuator system using hydraulic, pneumatic or electric actuation. Preferably, electric energy is used to actuate the pistons when starting an engine that produces electric output, and hydraulic or pneumatic energy is used to actuate the pistons when starting an engine that produces hydraulic or pneumatic output, respectively. When starting a free piston engine operating under compression ignition, a large compression ratio of the fuel-air charge in the cylinder is required to produce combustion.

If the pistons are reciprocated entirely by an actuator before combustion occurs while starting the engine, a large magnitude of energy is required to compress the mixture of fuel and air in the combustion chamber, particularly when cold starting a compression ignition free piston engine in cold weather. A technique is required to avoid the need for a large capacity energy source to start the engine.

SUMMARY OF THE INVENTION

A free piston engine to which this invention may be applied includes axially aligned cylinders and a pair of mutually connected pistons, each piston reciprocating in a cylinder.

An alternate form of the engine includes an inner pair of mutually connected pistons, and an outer pair of mutually connected pistons. One piston of each piston pair reciprocates in a first cylinder; the other piston of each pair reciprocates in a second cylinder. Each cylinder is formed with inlet ports, through which air enters the cylinder; exhaust ports, through which exhaust gas leaves the cylinder; and a fuel port, through which fuel is admitted, usually by injection, into the cylinder. Movement of the pistons in one cylinder, caused by combustion of a fuel-air mixture there, forces the pistons in the other cylinder to compress a fuel-air mixture in the second cylinder and to cause combustion of that mixture. In this way, the piston pairs reciprocate in the cylinders in mutual opposition, one piston pair moving longitudinal in one direction while the pistons of the other pair move in the opposite direction. When combustion occurs in a cylinder, the directions of movement of each piston pair reverse producing a compression stroke in the other cylinder.

When the engine stops, the pistons can be at any position in the cylinder. A free piston engine typically has no inlet valves or exhaust valves to control the flow of air and exhaust gas into and from the cylinder. Instead, a turbocharger driven by engine exhaust supplies a pressurized air charge to the cylinder through an inlet port. If the engine is stopped with a piston in the compression stroke, leakage of the air charge from the cylinder through inlet and exhaust ports and across the piston rings will occur during the shutdown period due to the pressure in the cylinder. This leakage can produce a partial vacuum in the cylinder. When the engine is restarted without a sufficient volume of air in each cylinder, a piston can collide with the cylinder head or with another piston in the same cylinder because of the air spring provides insufficient resistance to piston displacement.

To avoid relying on large hydraulic or pneumatic pressures in the starting actuator, a cyclic starting strategy has been developed. The pistons are reciprocated during starting with a progressively increasing displacement in order to develop a sufficient magnitude of kinetic energy in the pistons to produce combustion of the fuel-air charges. Energy applied to the pistons by a starting actuator and energy recovered from expansion of the compressed air charge before combustion occurs combine to increase the kinetic energy of the reciprocating pistons and to steadily increase pressure in the combustion chambers. When the engine is restarted without a sufficient volume of air in each cylinder, a piston can collide with the cylinder head or with another piston in the same cylinder because the restoring force produced by the compressed air charge is in adequate to limit piston displacement.

The method for starting the engine uses an actuator, such as a hydraulic or pneumatic pump-motor or an electric linear alternator-starter to move the pistons to a position where the inlet ports are opened. This ensures that air is present in a space within the cylinders that is confined during a portion of the starting procedure. That air space operates as an air spring during the starting procedure to store kinetic energy from the piston by compressing the air charge during a compression stroke to apply to the piston an air charge pressure force during an expansion stroke. The pistons reciprocate with an increasing displacement in response to the application of the actuator force and the pressure forces produced by the air spring, the compressible air charge in the combustion chamber. The spring rate of the air charges increases as the pressure of the air charge increases with piston displacement.

The actuator force is a periodic force preferably having a frequency that is the same or nearly the same as the variable natural frequency of the system, which includes the mass of the pistons, other masses reciprocating with the pistons, and the variable air spring. When piston displacement reaches a sufficient magnitude, fuel is admitted to the cylinder, preferably by injection. The actuator continues to increase piston displacement and pressure of the air-fuel mixture in the cylinder until sustained cyclic combustion of that mixture occurs. Instead of immediately placing load on the engine after combustion in the first cylinder occurs, preferably a period of delay occurs before placing full load on the engine. Force produced by the actuator can continue to be applied to the pistons or removed from the pistons while combustion continues in the first cylinder. During the delay period, fuel is admitted cyclically to the second cylinder while the piston in the second cylinder reciprocates. After sustained cyclic combustion of the fuel-air mixture in the second cylinder occurs, full load can be placed on the engine.

This invention is a method for controlling a servo for an actuator that applies a force to a piston that reciprocates in a cylinder of a free piston engine. The servo has a first state at which an energy source is connected to the actuator for developing the actuating force. The method includes determining the length of a response period for the actuator force to reach a desired magnitude after applying a control signal to the servo. The length of a period for the piston to reach a desired position where the actuator force will reach the desired magnitude is determined. The servo is switched to the first state when the length of time for the piston to move from its current position to the desired position reaches the length of the response period.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
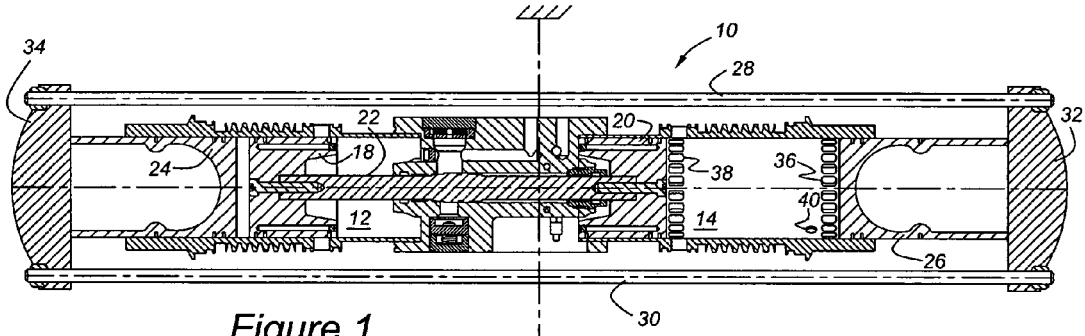
FIGS. 1 and 2 are cross sectional views taken at a longitudinal plane through a free piston engine showing schematically the position of piston pairs and combustion cylinders at opposite ends of their displacement.
Figure 2:
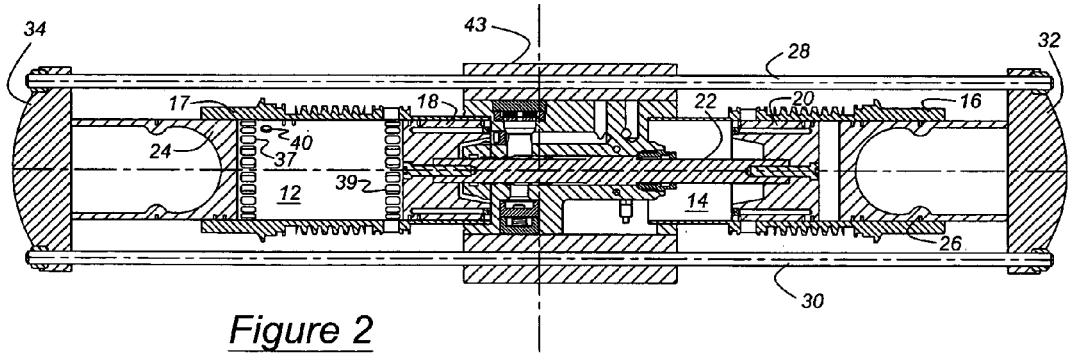

Referring first to FIGS. 1 and 2, a free piston engine 10 includes a first cylinder 12 and a second cylinder 14, axially aligned with the first cylinder, the cylinders being located in cylinder liners or engine blocks 16, 17. A first pair of pistons, inner pistons 18, 20, are mutually connected by a push rod 22. A first piston 18 of the first piston pair reciprocates within the first cylinder 12, and the second piston 20 of the first piston pair reciprocates within the second cylinder 14. A second pair of pistons, outer piston 22, 24, are connected mutually by pull rods 28, 30, secured mutually at the axial ends of pistons 24, 26 by bridges 32, 34. A first piston of the second or outer piston pair reciprocates within the first cylinder 12, and a second piston 26 of the outer piston pair reciprocates within the first cylinder 14. Each cylinder 12, 14 is formed with air inlet ports 36, 37 and exhaust ports 38, 39. In FIG. 1, the ports 37, 39 of cylinder 12 are closed by pistons 18, 24, which are located near their top dead center (TDC) position, and the ports 36, 38 of cylinder 14 are opened by pistons 18, 24, which are located near their bottom dead center (BDC) position. In FIG. 2, ports 36, 38 of cylinder 14 are closed by pistons 20, 26, which are located near their TDC position, and the ports 37, 39 of cylinder 12 are opened by pistons 18, 24, which are located near their BDC position. When the pistons of either cylinder are at the TDC position, the pistons of the other cylinder are at or near their BDC position. Each cylinder is formed with a fuel port 40, through which fuel is admitted, preferably by injection, into the cylinder during the compression stroke.

Displacement of the piston pairs between their respective TDC and BDC positions, the extremities of travel shown in FIGS. 1 and 2, is coordinated such that a fuel-air mixture located in the space between pistons 18, 24 in cylinder 12 and between pistons 20, 26 in cylinder 14 is compressed so that combustion of those mixtures occurs within the cylinders when the pistons have moved slightly past the TDC position toward the BDC position. This synchronized reciprocation of the piston pairs is referred to as "opposed piston-opposed cylinder" (OPOC) reciprocation.

Figure 3:
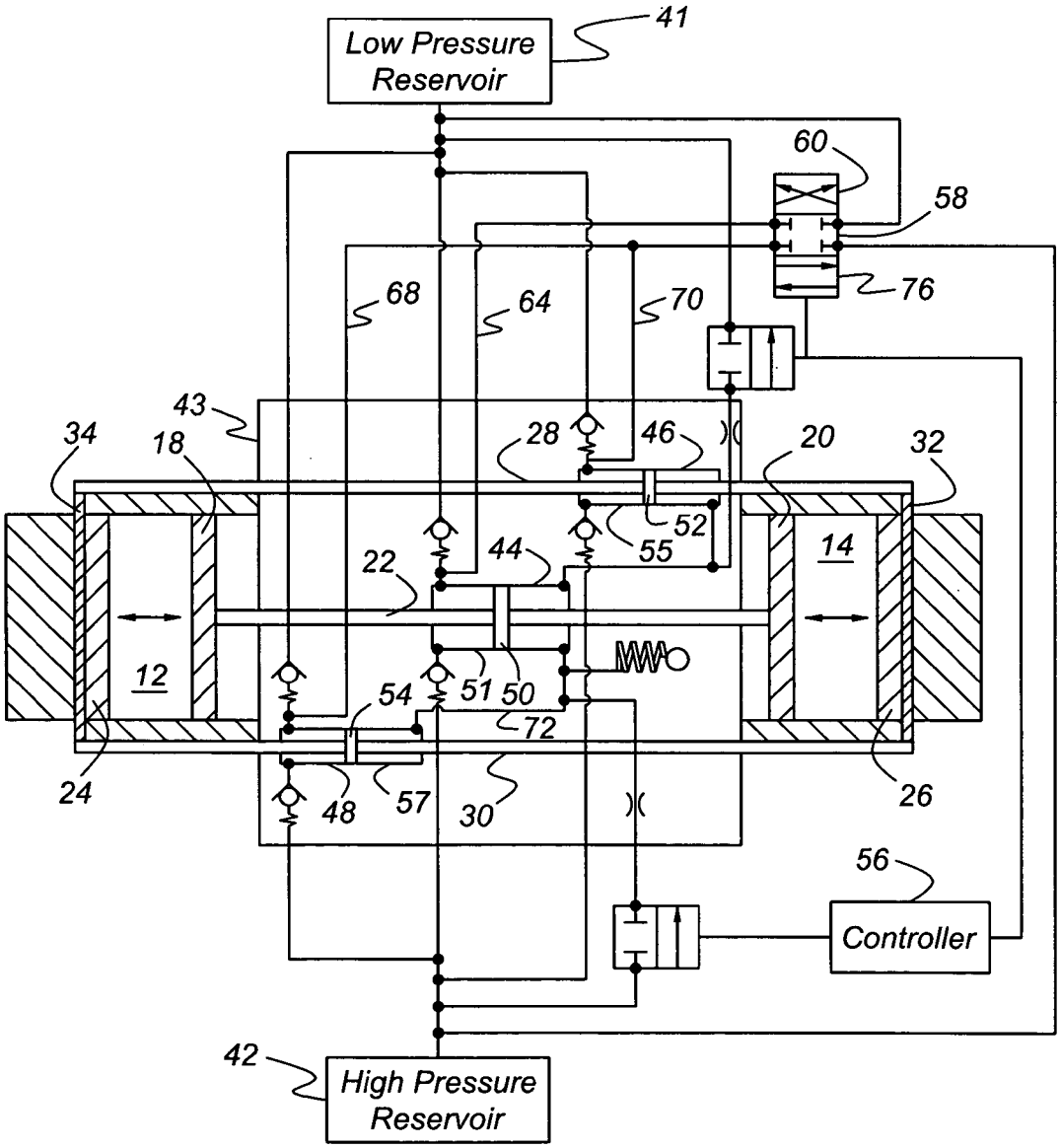
FIG. 3 is a schematic diagram of a fluid control system having a controller for operating fluid pump-motors connected to the engine piston pairs for starting the engine.
Figure 4A:
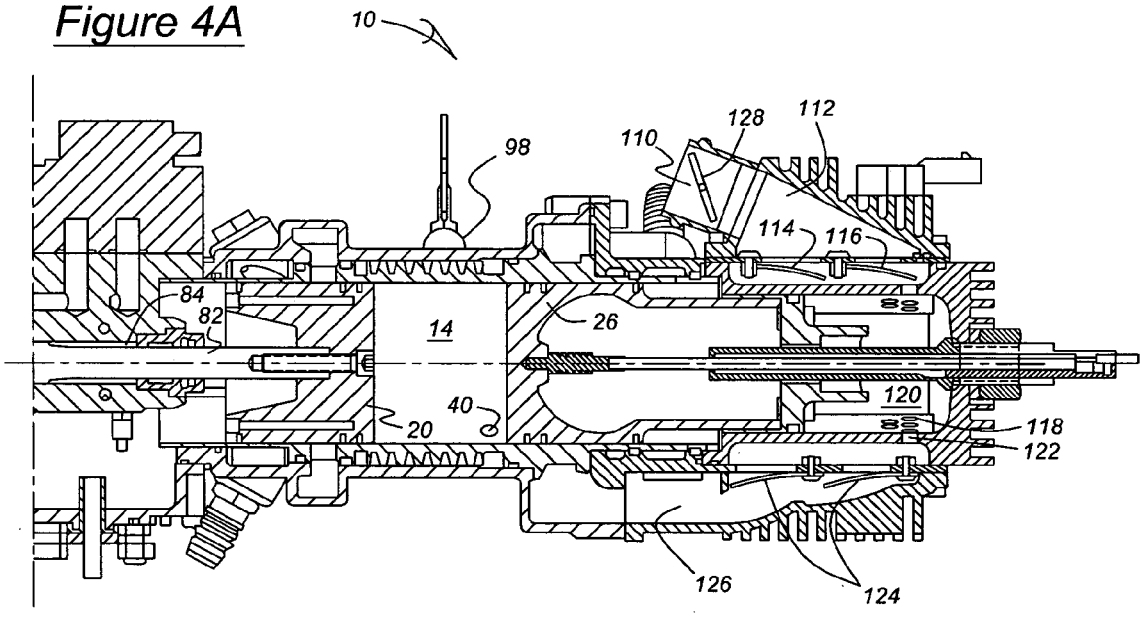
FIG. 4 is a cross section taken along a longitudinal plane of an engine and hydraulic motor-pump assembly.
Figure 4B:
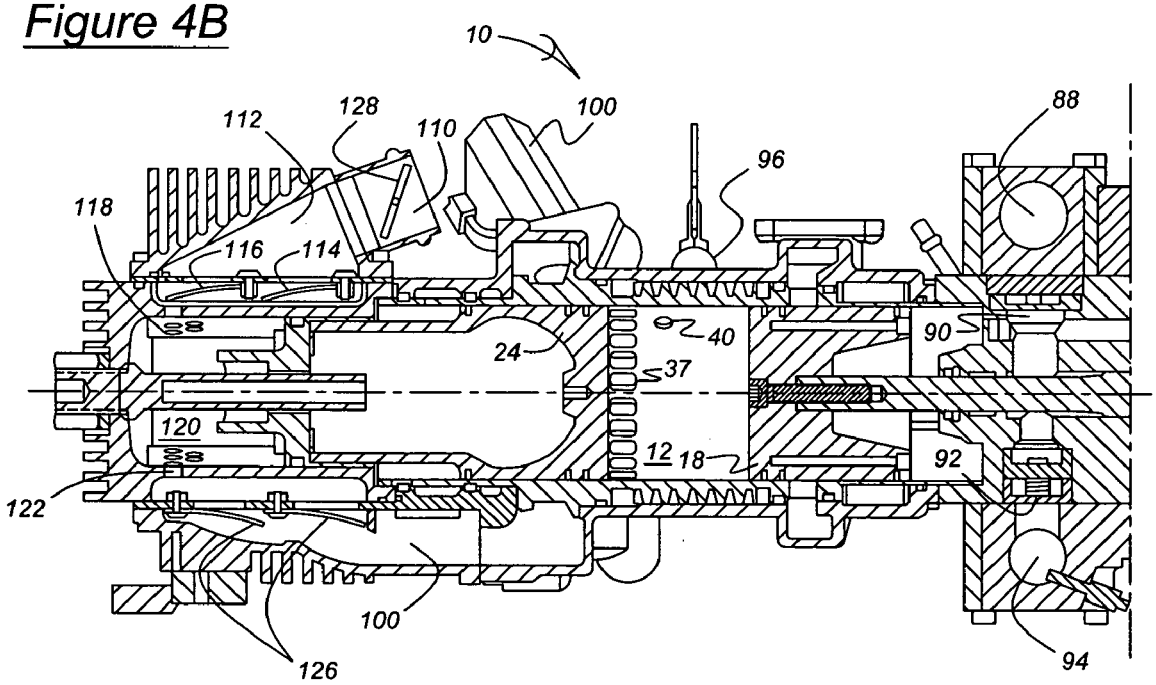
Figure 5:
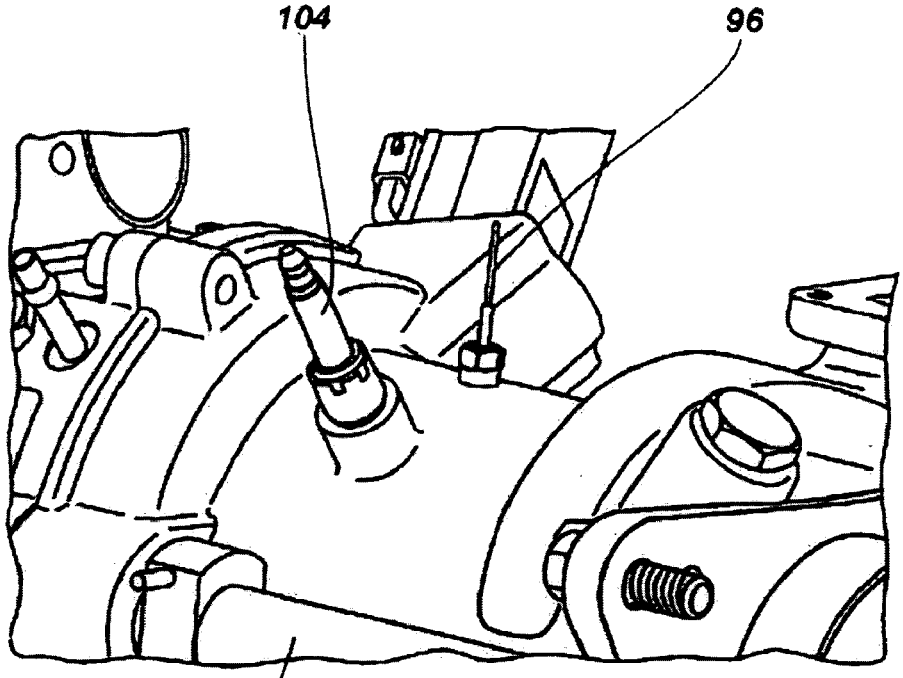
FIG. 5 is an isometric view of a portion of the outer surface of the engine of FIG. 1.
Figure 6:
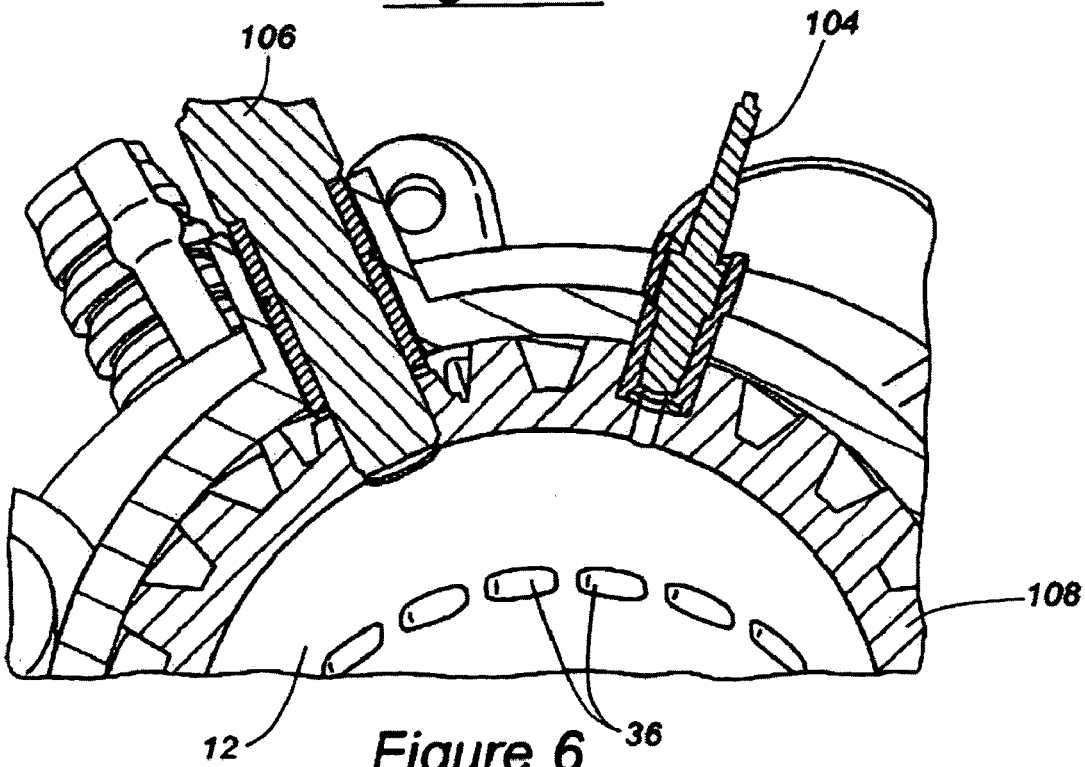
FIG. 6 is a partial transverse cross section of the engine of FIG. 1 taken at the location of a spark plug or a glow plug.

The synchronized, coordinated movement of the pistons is controlled through a hydraulic circuit, that includes fluid motor-pumps check valves and lines contained in a hydraulic or pneumatic block 43, located axially between the cylinder sleeves 16, 17. Referring next to FIG. 3, the control circuit includes a low pressure accumulator 41, a high pressure accumulator 42, a motor pump 44 driveably connected to push rod 22, a motor pump 46 driveably connected to pull rod 28, and a motor pump 48 driveably connected to pull rod 30. Push rod 22 is formed with a piston 50 located in a cylinder 51 formed in block 43. Reciprocation of engine pistons 18, 20 causes piston 50 of motor pump 44 to reciprocate. Pull rods 28, 30 are each formed with pistons 52, 54, located in cylinders 55, 57, respectively, formed in block 43. Reciprocation of engine pistons 24, 26 causes pistons 52, 54 of motor pumps 46, 48 to reciprocate.

When the engine 10 is running, the coordinated reciprocating movement of the engine pistons draws fluid from the low pressure accumulator 41 to the pump motors 44, 46, 48, which produce hydraulic or pneumatic output fluid flow, supplied to the high pressure accumulator 42. The motor-pumps 44, 46, 48 operate as motors driven by pressurized fluid in order to start the engine, and operate as pumps to supply fluid to the high pressure accumulator for temporary storage there or to supply fluid directly to fluid motors located at the vehicle wheels, which drive the wheels in rotation against a load.

An electronic controller 56 produces an actuating signal, a positive and negative voltage transmitted to a servo, which changes the states of a control valve 58 in response to the actuating sign. Preferably valve 58 is a fast-acting, high flow rate electromagnetic servo valve, such as that available commercially from Moog Inc., of East Aurora, N.Y. as its Part No. 35-196-4000-I-4PC-2-VIT.

When the hydraulic system is operating as a motor to move the engine pistons preparatory to starting the engine or while the engine is being started, controller 56 repetitively, cyclically switches valve 58 between a first state 60 and a second state 76. The first state connects accumulator 42 through valve 58 to the left-hand side of the cylinder 51 of pump-motor 44 through line 64. With valve 58 in the state 60, the left-hand sides of the cylinders 55, 57 of motor-pumps 46, 48 are connected through lines 68, 70 and valve 58 to the low pressure accumulator 41. These actions cause piston 50 to move rightward forcing fluid from pump-motor 44 through line 72 to the right-hand side of the cylinder 57, and through line 74 to the right-hand side of cylinder 55. In this way, the first state 60 of valve 58 causes the fluid control system to move inner engine pistons 18, 20 rightward and outer engine pistons 24, 26 leftward, to the position of these pistons shown in FIG. 2.

When controller 56 switches valve 58 to the second state 76, high pressure accumulator 42 is connected through line 68 to the left-hand side of piston 57 of motor-pump 48, and through line 70 to the left-hand side of piston 55 of motor-pump 46. This forces engine pistons 24, 26 rightward. When valve 58 is in the second state 76, the low-pressure accumulator 41 is connected through valve 58 and line 64 to the left-hand side of cylinder 51 of motor-pump 44. As pistons 52, 54 move rightward, fluid is pumped from cylinders 55, 57 through lines 74, 72, respectively, to the right-hand side of cylinder 51. This causes piston 50, push rod 22 and inner engine pistons 18, 20 to move leftward, and outer engine pistons 24, 26 to move rightward, to the position of these pistons shown in FIG. 1.

When starting the engine 10 and before fuel is injected, pistons 18, 20 are moved leftward and concurrently pistons 24, 26 are moved rightward by the actuator system toward the position shown in FIG. 1. This piston displacement is sufficient to allow the pistons to open the inlet ports 36 in cylinder 14, thereby ensuring that cylinder 14 is filled with a pneumatic charge, preferably an air charge. Next, pistons 18, 20 are moved rightward and concurrently pistons 24, 26 are moved leftward by the actuator system toward the position shown in FIG. 2. This displacement is sufficient to allow the pistons to open the inlet ports 37 in cylinder 12, thereby ensuring that cylinder 12 is filled with a pneumatic charge, preferably an air charge.

After an air charge is admitted to each cylinder, the actuator system reciprocates the pistons in cycles comprising successive compression and expansion strokes, without allowing inlet ports 36, 37 to open. During these strokes, piston displacement, length of the piston stroke, piston speed, peak compression pressure in the cylinders, and compression ratio of the air charges increase. The actuator connects high pressure accumulator 42 alternately to actuator motors 44, 46, 48 in order to displace the piston pairs 18–20, 24–26 in their respective cylinders 12, 14. Pressure developed in each cylinder during the compression strokes forces the pistons in each cylinder away from the TDC position during the expansion stroke. The increase of piston displacement during successive cycles is accomplished by progressively increasing the magnitude of the energy supplied to the system by the actuator motors during each displacement cycle, or lengthening the period during which actuator force is applied to the pistons, or changing the frequency of the periodic actuator force closer to the frequency of the system, or by combinations of these actions.

Cyclic compression and expansion of the air charges in cylinders 12, 14 are analogous to the effect of a compression spring located in each cylinder. Compression of the pneumatic charge in a cylinder opposes acceleration of the piston masses toward the TDC position in that cylinder. Expansion of the pneumatic charge in a cylinder assists in accelerating the piston masses toward the BDC position in that cylinder. As the charge in one cylinder is being compressed, the charge in the other cylinder is expanding. Therefore, pressure forces are continually developed that assist the pistons in each cylinder to move alternately toward the TDC and BDC positions in the correct phase relationship.

Figure 7:
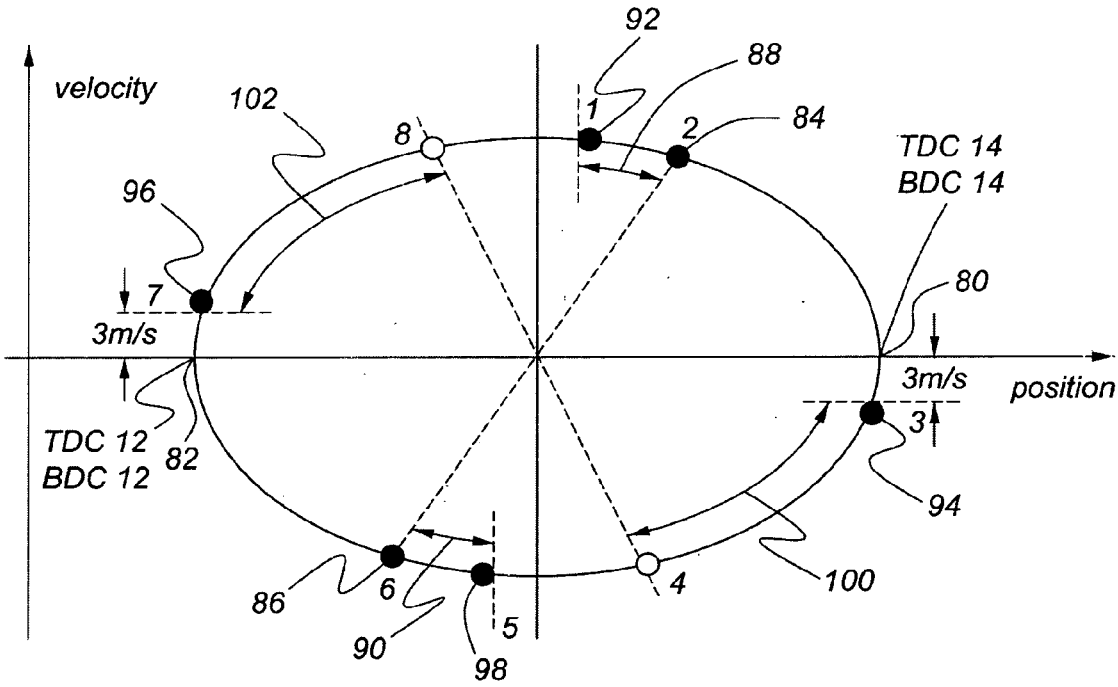
FIG. 7 is a phase diagram showing the variation of the velocity of the piston pairs versus position of the piston pairs relative to TDC and BDC.

FIG. 7 is a graph that shows the variation of piston position and piston speed during an engine cycle. The distance between two engine pistons in the same cylinder is sum=si+so, wherein si and so are the distance of the inner piston 18 and outer piston 24, respectively, from a reference position. Position sensors produce signals as input to the controller 56 representing the current location of those pistons relative to the reference position. Similarly, the relative velocity between engine pistons in the same cylinder is vel=vi+vo, wherein vi and vo are the speed of the inner piston 18 and outer piston 24, respectively. The controller 56 periodically samples the signals produced by the position sensors and determines the piston velocities from the piston position information.

When the pistons 18, 24 are moving toward each other, the velocity vel>0, which is represented by the portion of FIG. 7 located above the horizontal axis, the piston position axis. When the pistons in a cylinder are moving apart, then the velocity vel<0, which is represented by the portion of FIG. 7 located below the horizontal axis. The relative position (sum) of the pistons 18, 24 is limited by mutual piston contact, i.e., the pistons colliding (sum=0), and by piston end stops, which set the maximum distance the pistons can move apart (sum=smax). Instead of controlling the compression ratio or piston stroke at the TDC position, the piston velocity is controlled because it can be measured more accurately.

The period for the pistons to complete a full cycle of displacement, i.e., one loop around the ellipse of FIG. 7, is about 18 ms. depending on the mass that is oscillating with the pistons, and the stiffness of the air spring in cylinders 12 and 14. The operating frequency of the engine 10 does not change by more than about 20% due to the preferred oscillation in the natural frequency mode of the mass-spring system.

The piston pairs are subject to two sources of input energy: energy applied by the actuator, applied principally while starting the engine when the hydraulic actuator motor/pumps operate as a motor, and the energy released by combustion of the fuel. After starting the engine, the actuator is gradually turned off by the controller; thereafter, energy released by combustion of the fuel keeps the engine running independently of the actuator. Combustion energy is then converted to hydraulic energy, and the actuator is converted from operating as a motor to operating as a pump. The hydraulic actuator can be replaced by an electromagnetic machine, such as a linear starter-alternator, or by a pneumatic motor/pump.

Control of valve 58 is explained next with reference to the phase diagram of FIG. 7. Ideally the state of valve 58 would change instantaneously when the pistons are at the TDC and BDC positions, i.e., the extremities of piston travel where piston speed is zero (vel=0). In FIG. 7, TDC for pistons 20–26 and BDC for pistons 18–24 occurs at 80, and BDC for pistons 20–26 and TDC for pistons 18–24 occurs at 82. Valve 58, which includes an electromagnetic actuator, a spool valve, a spring mechanism, and some hydraulic flow passages, has a response time that depends on the valve structure and the applied voltage. The period required for valve 58 to respond to an actuating signal of +4 volts or −4 volts is approximately 5 ms. Therefore, it is necessary to actuate valve 58 in either direction (+4 v or −4 v) before the pistons reach their maximum and minimum positions (at vel=0) so that the maximum effective volume flow through valve 58 (or more generally, the effective energy input) occurs when the pistons are at the TDC and BDC positions 80, 82. In FIG. 7, the actuating signal is applied to valve 58 at the switching points 84, 86.

The switching point for each current cycle is optimized in time by using information obtained from a previous cycle, which information is recorded electronically and made accessible to the controller 56. The duration of check-delay periods is represented in FIG. 7 by the arrows 88 and 90. If the length of time required to move the pistons from point 92 to 94, or from 98 to 96 during the previous cycle is 7 ms., then the actuating voltage should be delayed about 2 ms. after point 92 before the voltage is applied to valve 58 at 84. Therefore, the state of valve 58 is switched at point 84, 5 ms. before the TDC and BDC piston position 80.

Valve 58 remains energized by the actuating voltage after the pistons reach their maximum/minimum positions 80, 82 until the pistons reach points 94 and 96, or as determined from the estimated piston velocity. For example, point 94 may occur about 1 ms. after the pistons reach point 80, and point 96 may occur about 1 ms. after the pistons reach point 82. When acceptable combustion occurs in cylinders 12, 14, high piston velocity (Vx) occurs about 1 ms. after TDC at 94, and valve 58 is energized for a shorter period than if combustion occurred before point 80. When combustion of the fuel-air mixture in the cylinders occurs too early, the peak pressure in the cylinders occurs about 400 $\mu$sec. before the pistons reach the TDC position. Early combustion decelerates the pistons on their way to TDC, and valve 58 must remain energized for a longer period after TDC, e.g. for 5 ms., than if combustion occurred when the pistons are at TDC.

After the engine is started and running, there are several ways to minimize the period during which valve 58 is energized:

1. Apply maximum voltage amplitudes (+4 or −4 volt) with interspersed zero voltage amplitudes. This might result in the following switching pattern +4, 0, −4, 0, +4, 0, −4, . . . volts. It has been demonstrated that good combustion occurs when no voltage is applied to valve 58 during the period represented by arrows 100 and 102.
2. Reduce the amplitude of voltage applied to valve 58 because lower voltage produces lower current, less displacement of the valve spool, and lower volume of fluid flow through valve 58. This might result in the following switching pattern: −4, +4, −4, +3, −2.5, +2, −2, +1, 0 volts. Lower actuating voltage is related to maximum piston velocity, which is a measure of the compression ratio.
3. A combination of methods 1 and 2.

Figure 8:
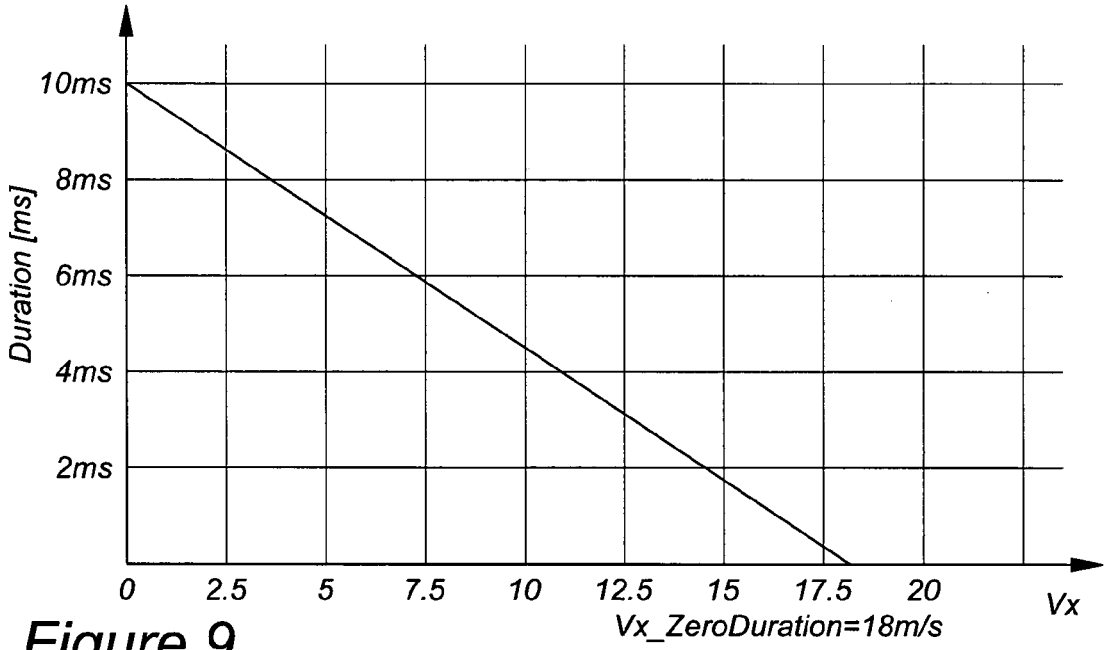
FIG. 8 is a graph showing the variation of duration with piston velocity.

After expiration of the period during which voltage is applied to valve 58 to drive the pistons to the position of FIG. 2, i.e., to control their movement to TDC in cylinder 14, the valve is switched OFF in preparation for driving the piston to the position of FIG. 1, TDC in cylinder 12. Vx is the linear approximated piston velocity 1 ms after TDC. The length of the period during which actuating voltage is applied to valve 58 (Duration) is adjusted with reference to two factors: Vx_Zero Duration and a Duration Factor. The piston speed at which no actuation voltage is applied to valve 58 is Vx_Zero Duration=18 ms. FIG. 8 illustrates the variation of Duration with Vx. The Duration of the actuating voltage pulse is determined by the following algorithm:

Check Combustion

| | |
|---|---|
| Determine piston velocity Vx | (linear approximated velocity 1 ms after TDC) |
| Calculate Dur1 = 5 − Vx * 5/18 | ms. |
| If combustion is early | (generate early combustion detector) |
| {Duration = 5 ms} | (maximum support for 5 ms.) |
| else | |
| {Duration = Dur1 + previous Dur1} | (one Dur1 from each cylinder) |
| Duration = Duration * MF | |

Check Duration

If Duration is timed out, switch valve 58 off.

Figure 9:
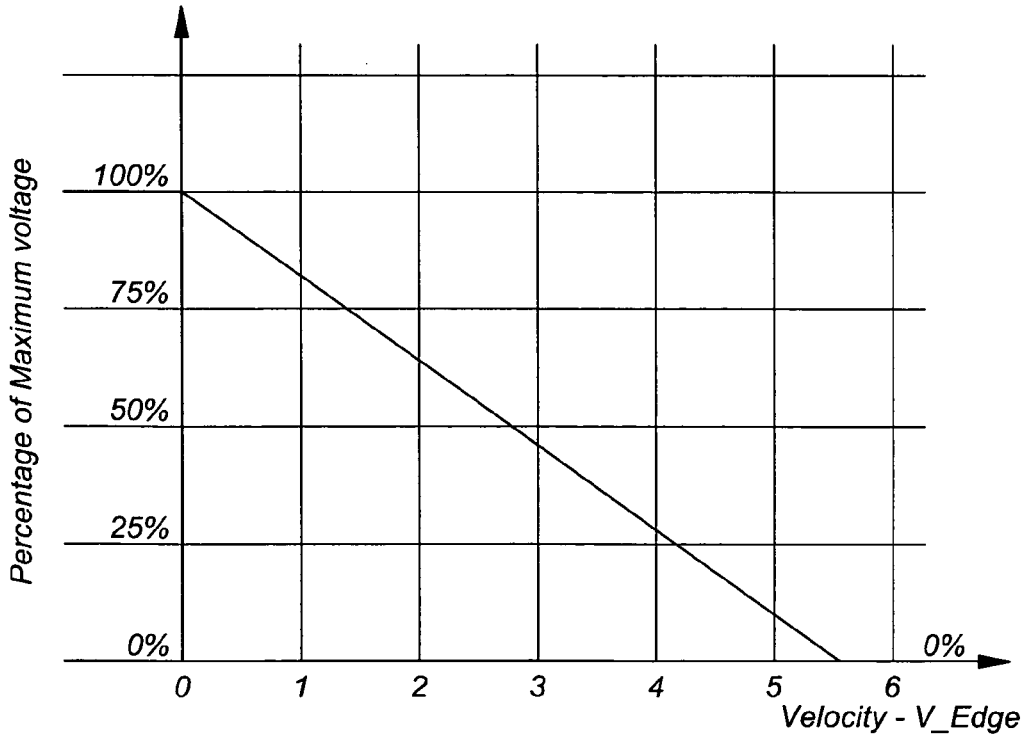
FIG. 9 is a graph showing the variation of a peak actuating voltage applied to the servo valve Vs a difference between piston velocity and a reference piston velocity.

The magnitude of actuating voltage to be applied to valve 58 during a current engine cycle is determined with reference to a factor MF. The value of MF is 1.0 when the maximum absolute velocity of the piston is less than a reference velocity (V_edge), and decreases from 1.0 linearly with piston velocity when the maximum absolute piston velocity is greater than V_edge. When the piston speed is more than 5.5 m/s faster than V_Edge, the actuating voltage applied to valve 58 is zero. The default value of V_Edge is 14.5 m/s. When Vel-V_Edge is 0.0 m/s, MF=1.0. FIG. 9 shows the variation of MF with the difference between piston velocity and V_Edge.

The control of actuation voltage delay is implemented by the following algorithm:

Decide Delay

| | |
|---|---|
| Delay = 5 ms - previous time from 98 to 96 | (5 ms. is response time of valve from 0→4 volt) |
| Delay = Delay * MF | (maximum 2.5 ms) |

Check Delay
If delay is timed out
(switch valve 58 ON (+4 volt or −4 volt)}

A fuel controller controls the desired absolute maximum piston velocity by controlling the desired fuel mass injected per cycle. The fuel mass consist of two parts: a constant load or (HP) high pressure dependent part, and a controlled maximum velocity part. The fuel controller is a PID-type controller, which prevents windup when one of the saturation limits is achieved. The fuel controller works in parallel with the valve controller 56, and all control mechanisms occur simultaneously.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method for controlling a servo for an actuator that applies energy to a piston that reciprocates in a cylinder of a free piston engine, the servo having a first state at which an energy source is connected to the actuator, the method comprising the steps of:

determining a first position at which the piston is located when the magnitude of energy to be applied through the actuator to the piston will reach a desired magnitude after applying a control signal to the servo;

determining a second position at which the piston is located at the beginning of a first period that begins upon applying the control signal and ends when the piston reaches the first position; and switching the servo to the first state by applying the control signal to the servo when the piston is at the second position.

2. The method of claim 1, further comprising:

providing an energy source that is one of a pressurized hydraulic energy source, a pressurized pneumatic energy source, and an electric energy source.

3. The method of claim 1, wherein the step of determining a first position of the piston further comprises:

determining the first position at which the piston is located when the magnitude of energy to be applied to the piston during a compression stroke will reach a desired magnitude after applying a control signal to the servo.

4. The method of claim 1, further comprising:

determining a speed of the piston at a predetermined time after the piston reaches TDC;

determining, with reference to said piston speed, a length of a second period during which the control signal is to be applied to the servo; and switching the servo from the first state when the second period expires.

5. The method of claim 4, wherein the step of determining a length of a second period (Dur) further comprises:

determining the response time (RT) of the actuator to a control signal applied to the servo;

determining the sum (Sum) of a length of a compression stroke and an expansion stroke;

calculating the length of the second period from Dur=RT−(Vx)*(RT/Sum), wherein Vx is the speed of the piston at a predetermined time after the piston reaches TDC.

6. The method of claim 1, further comprising:

determining a third position at which the piston is located when the magnitude of energy to be applied to the piston during an expansion stroke will reach a desired magnitude after applying a control signal to the servo;

determining a fourth position at which the piston is located at the beginning of a period that begins upon application of a control signal applied to the servo and ends when the piston reaches the third position; and switching the servo to a second state by applying a control signal to the servo when the piston is at the fourth position.

7. The method of claim 6, further comprising: determining a second speed of the piston at a predetermined time after the piston reaches BDC; and determining, with reference to said second piston speed, a length of a third period during which a control signal is to be applied to the third period expires; and switching the servo from the second state when the third period expires.

8. A method for controlling a servo for an actuator that applies a force to a piston that reciprocates in a cylinder of a free piston engine, the servo having a first state at which an energy source is connected to the actuator, the method comprising the steps of:

determining a length of a response period for the actuator force to reach a desired magnitude after applying a control signal to the servo;

determining the length of a period for the piston to reach a desired position where the actuator force will reach the desired magnitude; and switching the servo to the first state when the length of time for the piston to move from its current position to the desired position reaches the length of the response period.

9. The method of claim 8, further comprising:

providing an energy source that is one of a pressurized hydraulic energy source, a pressurized pneumatic energy source, and an electric energy source.

10. The method of claim 8, wherein the step of determining a length of a response period further comprises:

determining a length of a response period for the actuator force to reach a desired magnitude after applying a control signal of predetermined magnitude to the servo.

11. The method of claim 8, further comprising:

determining a speed of the piston at a predetermined time after the piston reaches TDC;

determining, with reference to said piston speed, a length of a first period during which the control signal is to be applied to the servo; and switching the servo from the first state when the first period expires.

12. The method of claim 11, wherein the step of determining a length of a first period (Dur) further comprises:

determining the response time (RT) of the actuator to a control signal applied to the servo;

determining the sum (Sum) of a length of a compression stroke and an expansion stroke;

calculating the length of the first period from Dur=RT−(Vx)*(RT/Sum), wherein Vx is the speed of the piston at a predetermined time after the piston reaches TDC.

13. The method of claim 8, further comprising:

determining a first position at which the piston is located when an actuator force to be applied to the piston during an expansion stroke will reach a desired magnitude after applying a control signal to the servo;

determining a second position at which the piston is located at the beginning of a period that begins upon application of a control signal applied to the servo and ends when the piston reaches the first position; and switching the servo to a second state by applying a control signal to the servo when the piston is at the second position.

14. The method of claim 13, further comprising:

determining a second speed of the piston at a predetermined time after the piston reaches BDC;

determining, with reference to said second piston speed, a length of a period during which a control signal is to be applied to the third period expires; and switching the servo from the second state when said period expires.

* * * * *